United States Patent [19]

Kwarta et al.

[11] Patent Number: 4,814,250

[45] Date of Patent: Mar. 21, 1989

[54] ELECTROPHOTOGRAPHIC TONER AND DEVELOPER COMPOSITIONS CONTAINING DIOCTYLSULFOSUCCINATE AND SODIUM BENZOATE CHARGE CONTROL AGENTS

[75] Inventors: Michelle S. Kwarta, Pittsford; Howard J. Helenbrook, Ontario; John M. Spence, Pittsford, all of N.Y.

[73] Assignee: Eastman Kodak Company, Rochester, N.Y.

[21] Appl. No.: 26,809

[22] Filed: Mar. 17, 1987

[51] Int. Cl.[4] ..... G03G 9/08

[52] U.S. Cl. ..... 430/110; 430/904

[58] Field of Search ..... 430/110, 904

[56] References Cited

U.S. PATENT DOCUMENTS

| | | | |
|---|---|---|---|
| 3,473,923 | 10/1969 | Ohknbo et al. | 430/120 |
| 3,502,582 | 3/1970 | Clemens et al. | 252/62.1 |
| 3,507,679 | 4/1970 | Metcalfe et al. | 430/115 |
| 3,694,359 | 9/1972 | Merrill et al. | 430/110 |
| 3,745,118 | 7/1973 | Brynko | 430/137 |
| 3,888,678 | 6/1975 | Bailey et al. | 430/115 X |
| 3,933,489 | 1/1976 | Walters | 430/104 X |
| 4,465,756 | 8/1984 | Mikami et al. | 430/138 |
| 4,473,629 | 9/1984 | Herrmann et al. | 430/115 |

*Primary Examiner*—J. David Welsh

*Attorney, Agent, or Firm*—David F. Janci

[57] ABSTRACT

A particulate electrophotographic toner includes a binder polymer having dispersed therein an amount, effective to control the charge on the toner particles, of a mixture of sodium dioctylsulfosuccinate and sodium benzoate.

17 Claims, No Drawings

ELECTROPHOTOGRAPHIC TONER AND DEVELOPER COMPOSITIONS CONTAINING DIOCTYLSULFOSUCCINATE AND SODIUM BENZOATE CHARGE CONTROL AGENTS

BACKGROUND OF THE INVENTION

This invention relates to electrophotography and, more especially, to particulate electrophotographic toners and developers.

Electrophotographic imaging processes have been described extensively in patents and other literature. These processes have in common the forming of an electrostatic charge pattern on an insulating photoconductor. The pattern, or latent electrostatic image, is made visible by contact with a developer containing electrostatically charged toner powder. Several methods of dry development are available, including the well-known magnetic brush and cascade development methods.

Most dry developers are a mixture of toner particles and carrier particles. For magnetic brush development the latter can be a magnetic substance such as iron filings, powdered iron or iron oxide. For cascade development and other methods the carrier particles can be non-magnetic substances such as glass or ceramic beads. The toner particles become triboelectrically charged by frictional contact with the carrier particles. Then, when contacted with the oppositely charged image pattern on the photoconductor, they adhere to the charged areas and make the image visible. In well-known office copying machines the developed toner image is transferred from the photoconductor to a sheet of plain paper to which it is fixed by fusion or other known techniques.

While the polymer is the major component of the toner, certain addenda usually are dispersed in the polymer. These can include one or more colorants such as pigments and dyestuffs which make the developed charge pattern visible. Also desirable as addenda are ionic compounds which help to maitain a uniform, stable, high net electric charge on the triboelectrically charged toner particles. These compounds are known as charge control agents.

A variety of charge control agents for toner particles have been proposed. For example, Olson U.S. Pat. No. 3,647,695 describes an electrostatic toner containing a mono- or di-functional organic acid nigrosine salt which aids in providing a relatively high uniform net electrical charge on the toner particles. It has been found, however, that the nigrosine salts decrease the adhesion of the toner particles to a paper receiving sheet.

Greig U.S. Pat. No. 3,079,272 describes the use of 4 to 5 percent by weight of anionic compounds, such as stearic acid, in "melt-form" in developer compositions containing particulate toner particles to "improve the triboelectric charge relationship" between the toner particles. However, it has been found that when fatty acids, such as stearic acid, are in the toner formulation it is difficult to impart a high net positive electrical charge to the toner particles with the magnetic carrier particles. Stearic acid also decreases the adhesion of the toner particles to paper.

Other useful charge control agents are the non-surfactant, short-chain, quaternary ammonium salts described in Jadwin et al. U.S. Pat. No. 3,893,935 and the alkoxylated amines described in Jadwin et al. U.S. Pat. No. 3,944,943. These quaternary ammonium salts and alkoxylated amines provide high, uniform net electrical charge to a toner powder without reducing the adhesion of the toner to paper. They are not, however, as effective as would be desired over a wide range of relative humidity.

Merrill et al. U.S. Pat. No. 3,694,359 issued Sept. 26, 1972 describes a dry toner containing a wetting agent including certain esters of sodium sulfosuccininc acid. The purpose of the wetting agent is to aid in promoting even, uniform contact between the toner and the paper support to which the toner image is ultimately fixed by heat. No indication is given that its addition serves to control the charging characteristics of the toner particles.

SUMMARY OF THE INVENTION

The present invention provides improved dry electrophotographic toner and developer compositions which employ as a charge control agent, a mixture of sodium dioctyl sulfosuccinate and sodium benzoate. The two ingredients of the charge control agent are present in the mixture in accordance with the following range:

sodium dioctyl sulfosuccinate 80 to 90 percent, by weight soidum benzoate 10 to 20 percent, by weight.

Preferably, 85 percent by weight of sodium dioctyl sulfosuccinate and 15 percent by weight of sodium benzoate are employed.

DESCRIPTION OF THE PREFERRED EMBODIMENTS

The improved toner composition of the invention comprises finely divided particles of a fusible binder polymer having dispersed therein an effective amount to control the charging properties of the toner of a mixture of sodium dioctyl sulfosuccinate and sodium benzoate. Advantageously, a colorant, such as, a pigment or a dye is also dispersed in the binder polymer of the toner.

The developer composition of the invention comprises toner particles and carrier particles. An especially preferred developer composition comprises a major amount of a styrene-acrylic binder polymer in particulate form and ferromagnetic carrier particles that charge the toner particles negatively.

The toner particles containing the charge control mixture in accordance with this invention achieve an extremely uniform charge when contacted with carrier particles. This is true regardless of the range of colorant, particularly carbon black employed in the binder which makes up the bulk of the toner composition. Also, because of the powdery nature of the charge control agent used herein, it is quickly and uniformly distributed throughout the binder material on a two roll rubber mill or in an extruder, such as a twin screw extruder as in the customary manner of formulating toner materials. It is believed that the uniform nature of the toner charge is due to the uniform, homogeneous nature of the blended bulk material when taken off the rubber mill or as it exits from the extruder orifice. Not only is the charge uniform initially, but it remains uniform over a long period of use and many thousands of copies.

The fusible binder polymers that can be used in the compositions of the invention include the various polymers that conventionally have been employed in dry electrophotographic toners. These have a glass transition temperature within the range from 40° to 120° C. Preferably, the toner particles have relatively high caking temperature, for example, higher than about 55° C., so that they may be stored without agglomerating. The softening temperature is within the range of from 40° C. to 200° C., and preferably from 40° C. to 65° C., so that the toner particles can readily be fused to paper receiving sheets. If other types of receiving elements are used, for example, metal printing plates, polymers having a higher softening temperature and glass transition temperature can be used.

Any suitable fusible binder polymer can be employed in the toner compositions of the invention including homopolymers and copolymers of styrene, polycarbonantes, resin-modified maleic alkyd resins, polyamides, phenol-formaldehyde resins and derivatives thereof, polyesters, modified alkyd resins, aromatic resins containing alternating methylene and aromatic units such as described in Merrill et al. U.S. Pat. No. 3,809,554, and fusible cross-linked polymers as described in Jadwin et al. U.S. Pat. No. 3,938,992, and the like.

Especially useful are styrene-acrylic copolymers of from 40 to 100 percent by weight of styrene or styrene homologs; from 0 to 45 percent by weight of one or more lower alkyl acrylates or methacrylates having from 1 to 4 carbon atoms in the alkyl group; and from 0 to 50 percent by weight of one or more other vinyl monomers, for example, a higher alkyl acrylate or methacrylate (including branched alkyl) and cycloalkyl acrylates and methacrylates having from 6 to 20 or more carbon atoms in the alkyl group. A preferred styrene-containing copolymer of this kind is prepared from a monomeric blend of 40 to 60 percent by weight styrene or styrene homolog, from 20 to 50 percent by weight of a lower alkyl acrylate or methacrylate and from 5 to 30 percent by weight of a higher alkyl acrylate or methacrylate such as ethylhexyl acrylate. The preferred fusible styrene copolymers are those which are covalently cross-linked with a small amount of a divinyl compound such as divinylbenzene. As is explained in more detail elsewhere in this specification, the charge control agent is especially suited for use with a binder polymer which is a copolymer of styrene and butylacrylate, made by emulsion polymerization and cross-linked with 0.05 to 3 weight percent of divinylbenzene.

The amount of binder polymer employed in the toner particles can vary but is usually greater than 50 percent by weight of the toner composition. Preferred are amounts of binder polymer within the range from 75 to 98 weight percent based on the total weight of the toner composition.

A convenient method for preparing the toner is melt blending. This involves melting the binder polymer and mixing it with dyes or pigments and the charge control agent on heated compounding rolls or in an extruder. After thorough blending, the mixture is cooled and solidified. The solid mass is broken into small particles and finely ground to form a free-flowing powder of toner particles.

Particles of mean diameter between 0.1 micrometer and 100 micrometers may be used; although, present day office copying machines employ particles of mean diameter between 1 to 30 μm. Larger or smaller particles can be used for particular methods of development. For example, in powder cloud development such as described in U.S. Pat. No. 2,691,345, extremely small toner particles can be used.

The charge control agents are added to the toner in an amount effective to improve the charge properties of the toner composition. These charge control agents improve the charge uniformity of a toner composition, that is, they insure that substantially all of the individual toner particles exhibit a triboelectric charge of the same sign (negative or positive) with respect to a given carrier; they control the net electrical charge of the toner particles relative to a given carrier vehicle; and they reduce the amount of "toner throw-off." As used herein, the phrases "net electrical charge of the toner particles" and "net toner charge" are equivalent and are defined as the total electrical charge on a given amount of a toner when admixed with a given amount of carrier. Although the phenomenon by which such an electrical charge is imparted is not fully understood, it is believed due in large part to the triboelectric effect of the physical admixture of toner and carrier. The term "toner throw-off" is defined as the amount of toner powder thrown out of a developer mix as it is mechanically agitated, e.g., in a development apparatus. Aside from the extraneous contamination problems inherent with airborne toner dust, "toner throw-off" also leads to imaging problems such as unwanted background development and scumming of the photoconductor.

In the toner compositions of the present invention it has been found desirable to employ an amount of charge control agent within the range of 0.01 to 3 weight percent and preferably 0.2 to 2 weight percent based on the total weight of the particulate toner composition. If much lower amounts are used, the charge control agent provides little or no effect. If much higher amounts are used, the net charge of the toner becomes unstable and is substantially reduced. The optimum amount will depend in the components selected for the particular toner composition.

A variety of dyestuffs and pigments can be employed as colorants in the toner compositions of the invention. Of course, toners can be prepared without the use of a colorant if it is desired to have a developed image of low optical opacity. If used, however, the colorant can be virtually any of the compounds mentioned in the *Colour Index*, Volumes 1 and 2, Second Edition, Carbon black is a preferred colorant. The amount of colorant can vary over a wide range, for example, from about 1 to about 20 percent of the weight of the polymeric binder. Particularly good results are obtained when the amount is from 2 to 10 weight percent.

The toners of this invention normally are mixed with a carrier to form developing compositions, however, single component developers are also contemplated. Suitable carriers include various nonmagnetic particles such as glass beads, crystals of inorganic salts such as sodium or potassium chloride, hard resin particles, metal particles, etc. In addition, magnetic carrier particles can be used. Suitable magnetic carrier materials include ferromagnetic materials such as iron, cobalt, nickel, and alloys and mixtures thereof.

In developers for use in magnetic brush development the carrier preferably comprises ferromagnetic particles. The particles may be overcoated with a thin or discontinuous layer or film forming resin, for example, a fluorocarbon polymer such as polytetrafluoroethylene, polyvinylidene fluoride or a copolymer of vinylidene fluoride and tetrafluoroethylene or an alkali-soluble carboxylated polymer as described in Miller U.S. Pat.

No. 3,547,822. Other useful resin-coated magnetic carrier particles are described in Miller, U.S. Pat. No. 3,632,512; McCabe, U.S. Pat. No. 3,795,617; and Kasper U.S. Pat. No. 3,795,618. A suitable carrier comprises an iron core which has been subjected to high temperature oxidation treatment in a fluidized bed as described in U.S. Pat. No. 3,767,477 to form a high resistance, durable, iron oxide layer thereon. Preferably, the carrier particles are uncoated sponge iron ground to a fine powder and reduced by heating with hydrogen. The particles have a porosity of about 50% void spaces and an average particle size varying from about 80 to about 150 μm (Sold by Hoeganaes Corp. under the name Ancor EH). The resultant carrier may be preconditioned as described in Olson et al. U.S. Pat. No. 3,970,571 at least a portion of the toner removed and fresh toner added thereto before use.

A typical developer composition containing the described toner and carrier particles comprises from about 1 to about 10 percent by weight of toner particles. The carrier particles can have a particle size of from about 30 to about 1200 microns, preferably 50–300 μm, and thus usually are larger than the toner particles. Developer compositions of the invention can also, however, employ smaller carrier particles, including those which are of about the same size as the toner particles, e.g., of 1 to 30 microns average diameter.

The following examples provide a further understanding of the invention.

EXAMPLE

About 100 parts by weight of poly(styrene-co-butylacrylate-co-divinyl benzene) (75:25:6), about 10 parts by weight of Regal 300 carbon black obtained from Cabot Corp. and about 2 parts by weight of a mixture of 85 weight percent sodium dioctyl sulfosuccinate and 15 weight percent of sodium benzoate (the mixture is sold as Aerosol OT-B" surfactant by American Cyanamide) are introduced into a hopper of a twin screw extruder at a feed rate of 100 kilograms/hour. The temperature in the extruder is maintained at about 121° C. The extrudate is chopped at the die face into pellets which are subsequently ground in a fluid energy mill to a fine powder having an average particle size of about 11 μm.

About 2.5 parts by weight of the toner particles prepared as above, are mixed with 100 parts of a sponge iron powder (Hoeganaes EH) having an average particle size of about 125 μm sold by Hoeganaes Corp. which charges the toner particles negatively. This developer is utilized in a Kodak Ektaprint® 250 Copier the photoreceptor of which is negatively charged. The photoreceptor is discharged in image configuration by a series of light emitting diodes which forms a latent image on the photoreceptor. This latent image is developed with above toner which is brought into the vicinity of the image by the magnetic brush development system of the Ektaprint® copier.

A sample of the toner is taken from the developer sump at various times over the production of 800,000 prints and the charge on the particles is consistently between 11 and 16 microcoulombs per gram.

The invention has been described in detail with particular reference to preferred embodiments thereof, but it will be understood that variations and modifications can be effected within the spirit and scope of the invention.

We claim:

1. A particulate electrophotographic toner comprising a fusible binder copolymer of styrene-alkyl acrylate and dispersed therein an effective amount to control charge on said toner particles, where said amount is between about 0.01 to 3 percent by weight, based on the weight of said toner, of a mixture of (a) about 80 to about 90 percent by weight, based on the weight of said mixture, of sodium dioctyl sulfosuccinate and (b) about 10 to about 20 percent by weight, based on the weight of said mixture, of sodium benzoate.

2. The particulate electrophotographic toner of claim 1 wherein sodium benzoate is present in an amount of about 15 percent, by weight, based on the weight of said mixture.

3. The particulate electrophotographic toner of claim 1 wherein the binder polymer has a colorant dispersed therein.

4. The particulate electrophotographic toner of claim 1 wherein the colorant is carbon black.

5. The particulate electrophotographic toner of claim 1 wherein the binder polymer is poly (styrene-co-butyl acrylate-co-divinyl benzene).

6. The particulate electrophotographic toner of claim 5 wherein the binder polymer contains about 10 percent, by weight, of carbon black.

7. An electrophotographic developer comprising carrier particles and about 1 to about 10 percent by weight toner particles, said toner particles comprising a fusible binder copolymer of styrene-alkyl acrylate having dispersed therein an effective amount to control charge on said toner particles, where said amount is between about 0.01 to 3 percent by weight, based on the weight of said toner, of a mixture of (a) about 80 to about 90 percent by weight, based on the weight of said mixture, of sodium dioctyl sulfosuccinate and (b) about 10 to about 20 percent by weight, based on the weight of said mixture, of sodium benzoate.

8. The electrophotographic developer of claim 7 wherein said carrier comprises iron particles having an average particle size of from 50 to 300 μm.

9. The particulate electrophotographic toner of claim 1 wherein said binder copolymer has a glass transition temperature of 40 to 120° C.

10. The particulate electrophotographic toner of claim 1 wherein said toner has a caking temperature higher than about 55° C. and a softening temperature from 40 to 200° C.

11. The particulate electrophotographic toner of claim 10 wherein said softening temperature is from 40 to 65° C.

12. The particulate electrophotographic toner of claim 5 wherein the amount of said divinylbenzene is about 0.05 to about 3 weight percent.

13. The particulate electrophotographic toner of claim 1 wherein the amount of said binder copolymer is 75 to 98 percent by weight, based on the weight of said toner.

14. The particulate electrophotographic toner of claim 1 wherein the mean diameter of toner particles is 1 to 30 μm.

15. The particulate electrophotographic toner of claim 1 wherein said mixture is 0.2 to 2 weight percent, based on the weight of said toner.

16. The particulate electrophotographic toner of claim 1 wherein the amount of said colorant is 2 to 10 percent by weight.

17. The electrophotographic developer of claim 7 wherein said carrier comprises ferromagnetic particles.

* * * * *